US010215184B2

(12) United States Patent
Matheidas et al.

(10) Patent No.: US 10,215,184 B2
(45) Date of Patent: Feb. 26, 2019

(54) CONTROLLING A WET GAS COMPRESSION SYSTEM

(71) Applicants: Michael T. Matheidas, The Woodlands, TX (US); Stanley O. Uptigrove, Kuala Lumpur (MY)

(72) Inventors: Michael T. Matheidas, The Woodlands, TX (US); Stanley O. Uptigrove, Kuala Lumpur (MY)

(73) Assignee: ExxonMobil Upstream Research Company, Spring, TX (US)

( * ) Notice: Subject to any disclaimer, the term of this patent is extended or adjusted under 35 U.S.C. 154(b) by 323 days.

(21) Appl. No.: 15/042,528

(22) Filed: Feb. 12, 2016

(65) Prior Publication Data

US 2016/0281724 A1 Sep. 29, 2016

Related U.S. Application Data

(60) Provisional application No. 62/138,748, filed on Mar. 26, 2015.

(51) Int. Cl.
*F04D 27/02* (2006.01)
*F04D 17/10* (2006.01)
(Continued)

(52) U.S. Cl.
CPC ..... *F04D 27/02* (2013.01); *F04D 17/10* (2013.01); *F04D 25/02* (2013.01); *F04D 27/001* (2013.01); *F04D 29/705* (2013.01); *F04D 31/00* (2013.01); *F04D 17/12* (2013.01); *F05D 2270/101* (2013.01); *F05D 2270/3011* (2013.01);
(Continued)

(58) Field of Classification Search
CPC ..... F04D 17/10; F04D 17/12; F04D 25/02; F04D 27/001; F04D 27/02; F04D 29/705; F04D 31/00; F05D 2270/101; F05D 2270/3011; F05D 2270/3013; F05D 2270/3015; F05D 2270/311;
(Continued)

(56) References Cited

U.S. PATENT DOCUMENTS 1,385,318 A 7/1921 Elling
2,280,845 A 4/1942 Parker
(Continued)

FOREIGN PATENT DOCUMENTS

CN 202520580 11/2012 ..... F04D 25/06
JP 2000-097197 4/2000
(Continued)

*Primary Examiner* — William McCalister
(74) *Attorney, Agent, or Firm* — ExxonMobil Upstream Research Company Law Department

(57) ABSTRACT

The disclosure includes controlling a pressure ratio for a compressing system, comprising introducing a quantity of liquid into an input stream to create a multiphase input stream, compressing the multiphase input stream with a centrifugal compressor to create a discharge stream, measuring a parameter of the discharge stream, wherein the discharge parameter corresponds to a pressure ratio for the centrifugal compressor, when the parameter exceeds a first predetermined point, increasing a pressure ratio of the centrifugal compressor by increasing the quantity of liquid introduced, and when the parameter exceeds a second predetermined point, decreasing the pressure ratio by decreasing the quantity of liquid introduced.

10 Claims, 4 Drawing Sheets

(51) Int. Cl.

| | |
|---|---|
| ***F04D 25/02*** | (2006.01) |
| ***F04D 31/00*** | (2006.01) |
| ***F04D 27/00*** | (2006.01) |
| ***F04D 29/70*** | (2006.01) |
| *F04D 17/12* | (2006.01) |

(52) U.S. Cl.
CPC ..... *F05D 2270/3013* (2013.01); *F05D 2270/3061* (2013.01); *F05D 2270/311* (2013.01); *F05D 2270/54* (2013.01)

(58) Field of Classification Search
CPC ..... F05D 2270/306; F05D 2270/3061; F05D 2270/54
USPC ..... 415/116, 117
See application file for complete search history.

(56) References Cited

U.S. PATENT DOCUMENTS

| | | | | |
|---|---|---|---|---|
| 2,786,626 | A | 3/1957 | Redcay | |
| 4,571,151 | A | 2/1986 | Paul | 415/1 |
| 4,918,931 | A | 4/1990 | Lowes | 62/83 |
| 6,273,674 | B1 | 8/2001 | Charron | |
| 6,463,740 | B1 * | 10/2002 | Schmidt | F02C 9/56 192/3.29 |
| 6,900,553 | B2 * | 5/2005 | Gozdawa | F01D 5/08 290/31 |
| 7,331,753 | B2 | 2/2008 | Harazin | |
| 7,712,301 | B1 * | 5/2010 | Wagner | F01D 25/002 134/23 |
| 2003/0010502 | A1 | 1/2003 | Poorte et al. | 166/373 |
| 2003/0126884 | A1 | 7/2003 | Bush et al. | 62/505 |
| 2004/0245182 | A1 | 12/2004 | Appleford et al. | 210/739 |
| 2007/0227969 | A1 | 10/2007 | Dehaene et al. | 210/603 |
| 2008/0168761 | A1 | 7/2008 | Savic | 60/39.53 |
| 2012/0224980 | A1 | 9/2012 | Uptigrove | 417/53 |
| 2013/0209299 | A1 | 8/2013 | Santos et al. | 418/1 |

FOREIGN PATENT DOCUMENTS

| | | | |
|---|---|---|---|
| JP | 2012-122421 | 6/2012 | |
| WO | WO2003/089770 | 10/2003 | F02C 3/30 |
| WO | 2014/006371 | 1/2014 | E21B 43/34 |
| WO | 2014/027895 | 2/2014 | E21B 43/12 |

* cited by examiner

CONTROLLING A WET GAS COMPRESSION SYSTEM

CROSS REFERENCE TO RELATED APPLICATIONS

This application claims the priority benefit of U.S. patent application Ser. No. 62/138,748 filed Mar. 26, 2015 entitled CONTROLLING A WET GAS COMPRESSION SYSTEM, the entirety of which is incorporated by reference herein.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

Traditionally, it is understood that centrifugal compressors or gas expanders do not handle liquid slugs and thus it is assumed that they can only handle a fraction of one percent liquid by volume. Thus in many applications expensive liquid separators, dehydration processes and/or unit scrubbers are utilized to try and remove or separate the liquids prior to using centrifugal compressors or expanders. These devices are often designed for specific operating conditions and are then limited in the range of Gas Volume Fraction (GVF) that can be handled with a given process flow rate. Even with this expensive and complex processing equipment, if there is a sudden high level of liquids they can quickly saturate, fill and overflow the liquid separators once their capacity for liquid is exceeded resulting in slugging the compressor or expander equipment.

In general, multiphase pumps can be used if it is known that the fluid will generally be below 90% GVF. Centrifugal compressors are often restricted to applications with GVFs of 99.7 or higher and even this can cause problems within the machine for stability and affecting the reliability of the seals and bearings. Therefore, for processes outside this small range, the current practice is to separate the fluids prior to utilizing a centrifugal compressor even with the design limitation with the associated process and equipment. The same is true for gas expanders, which are functionally a centrifugal compressor running in reverse to extract energy in one form or another through a process pressure drop across the expander. The separators, scrubbers and dehydration units are not only expensive and limited in liquid capacity and volume flow range but they also tend to be very bulky, taking up expensive real estate in locations such as offshore platforms, subsea processing or onshore facilities. This coupled with complex control systems and additional auxiliary equipment like pumps, regulators, level controllers, transmitters and filters adds to the complexity and likelihood of failure of these systems. An example of a typical oil or gas well stream service process may use a separator to separate liquids from the gas in order to prevent or mitigate damage caused by slugs. A centrifugal compressor and pump may subsequently be used to boost the gas and liquid separately, with downstream recombination of the gas and liquid in order to transport both through a pipeline to a processing facility.

Problems with compressing liquids include reduced machine stability, erosion of impellers and diffusers, and fouling and resulting in imbalance if the liquids flash or vaporize while being compressed in the machine.

The foregoing discussion of need in the art is intended to be representative rather than exhaustive. Technology that would improve the ability of compressors or expanders to handle the multiphase flow of fluid with a higher liquid content compared to the current state of the art would be of great value.

SUMMARY OF THE INVENTION

The disclosure includes a method of controlling a pressure ratio for a compressing system, comprising introducing a quantity of liquid into an input stream to create a multiphase input stream, compressing the multiphase input stream with a centrifugal compressor to create a discharge stream, measuring a parameter of the discharge stream, wherein the discharge parameter corresponds to a pressure ratio for the centrifugal compressor, when the parameter exceeds a first predetermined point, increasing a pressure ratio of the centrifugal compressor by increasing the quantity of liquid introduced, and when the parameter exceeds a second predetermined point, decreasing the pressure ratio by decreasing the quantity of liquid introduced.

The disclosure includes a method of controlling a compressor surge for a compressing system, comprising introducing a quantity of liquid into an input stream to create a multiphase input stream, compressing the multiphase input stream with a centrifugal compressor to create a discharge stream, measuring a parameter of the discharge stream, the input stream, or both, wherein the parameter corresponds to a surge line or a surge margin for the centrifugal compressor, when the parameter exceeds a first predetermined point, reducing the compressor surge of the centrifugal compressor by increasing the quantity of liquid introduced, and when the parameter exceeds a second predetermined point, decreasing the quantity of liquid introduced.

The disclosure includes a compressor system, comprising: an inlet configured to pass an inlet stream comprising gas, a fluid injection device configured to receive the inlet stream, introduce a liquid stream comprising atomized liquid, and create a multiphase inlet stream, a centrifugal compressor configured to receive and compress the multiphase inlet stream and pass a discharge stream, a driver configured to drive the centrifugal compressor, a discharge configured to pass the discharge stream, and a liquid stream injection controller configured to adjust the quantity of atomized liquid introduced into the inlet stream at the fluid injection device.

DESCRIPTION OF THE DRAWINGS

So that the manner in which the present invention can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

Figure 1:
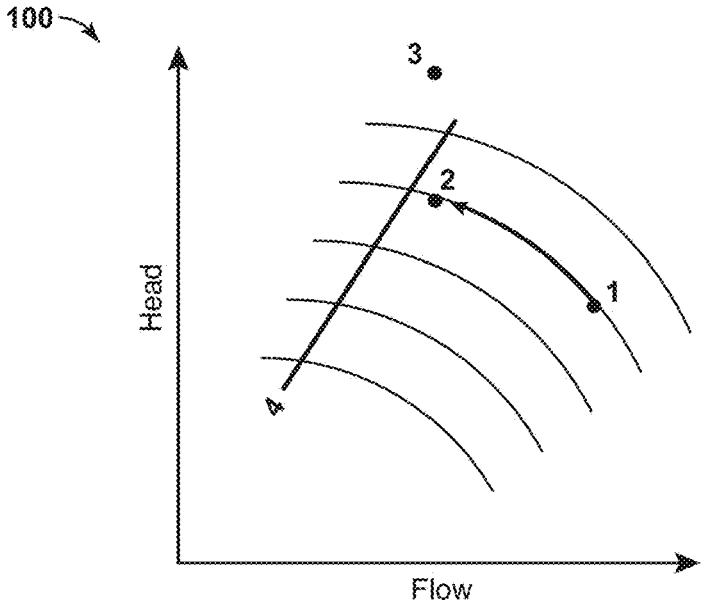
FIG. 1 is an illustrative compressor performance map showing a traditional sequence of operating points moving into a region of higher pressure ratio/head.

It should be noted that the figures are merely exemplary of several embodiments of the present invention and no limitations on the scope of the present invention are intended thereby. Further, the figures are generally not drawn to scale, but are drafted for purposes of convenience and clarity in illustrating various aspects of the invention.

DETAILED DESCRIPTION

Reference will now be made to exemplary embodiments and specific language will be used to describe the same. It will nevertheless be understood that no limitation of the scope of the invention is thereby intended. Alterations of further modifications of the inventive features described herein, and additional applications of the principles of the invention as described herein, which would occur to one skilled in the relevant art and having possession of this disclosure, are to be considered within the scope of the invention. Further, before particular embodiments of the present invention are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

Testing has shown that erosion can be reduced or prevented by slowing down the liquid velocity at impact points and by reducing the droplet size. Fouling has also been reduced or even removed by increasing the liquid levels above the flash point in effect washing the internals of the machine. Disclosed techniques include using the thermodynamic and aerodynamic effects of liquid injection as a control method for a centrifugal compressor system. Whereas current technology focuses on conditioning, restricting, and/or minimizing the amount of liquid, the disclosed techniques include intentionally adding liquid and/or changing the liquid fraction to obtain a change in the operating condition(s) of the compressor system.

Suitable liquids and/or injectants include one of or a combination of water, produced water, liquid hydrocarbons, corrosion inhibitor (e.g., water soluble or oil soluble chemicals (often amine based) used to inhibit aqueous corrosion), process liquid(s), diluents (e.g., xylene, etc.), liquid chemicals (e.g., glycols, amines, etc.), drilling fluids, fracking fluids, etc. The liquids and/or injectants may be byproducts of an existing process in a facility or a liquid from an external source. Suitable compressor systems include those found in surface facilities, subsea applications, pipeline applications, gas gathering, refrigeration, etc., as well as future possible configurations of centrifugal compressor systems such as in-pipe compressors and/or down-hole compressors.

As described above, adding liquid may increase the pressure ratio of a centrifugal compressor. In other words, the non-compressibility of the liquid may be utilized to increase pressure producing capability of the compressor. For example, as reservoirs deplete and enhanced oil recovery (EOR) with water is undertaken, a higher compression ratio with lower volumes of gas and additional liquid may be required. Using the liquid may replace a problem with a benefit that may eliminate the need to re-wheel, re-stage, and/or re-bundle a compressor.

FIG. 1 is an illustrative compressor performance map 100 plotting pressure ratio (PR) (the pressure at the compressor exducer versus the pressure at the compressor inducer) or head on the Y-axis against flow (e.g., in actual cubic feet per minute (ACFM)) on the X-axis. In FIG. 1, points 1 and 2 depict exemplary operating points of a conventional centrifugal compressor for a given speed range over a range of flows.

Surge line 4 separates a region of unstable flow above the surge line 4 from a region of stable flow below the surge line 4. If a compressor operates above and/or on the left side of the surge line 4, the compressor may surge or pulsate backflow of gas through the device. In general, the surge line 4 may signify the minimum flow rate limit for a given compressor.

Injecting liquid at operating point 2 allows the compressor to increase the PR and/or produce more head than the original design, depicted by the operating condition moving vertically along the performance map to point 3. As described above, the ability to increase the PR may be advantageously exploited in a variety of contexts, e.g., EOR operations, to accommodate lower wellhead pressure, to compensate for changing gas composition, to counter increased resistance in an associated discharge system, etc. In some embodiments, liquid ingestion increases the pressure ratio above pre-established surge limits but does not cause the surge phenomenon to occur. Additionally, injecting liquid may extend the surge range of a given compressor, thereby permitting compressors to operate in low flow regions without exhibiting excessive pressure reversals or oscillating axial shaft movement. This technique may be more efficient than opening a recycle line (current technology) or venting gas at an inlet of the compressor. Further, injecting liquid may mitigate possible slugging and liquid carry-over damage to brownfield compressors. For example, a static mixer at a compressor inlet nozzle may atomize a liquid into droplets to reduce possible slugging on the compressor when existing (brownfield) suction scrubbers have liquid carry-over (e.g., due to instrument failure, system upsets, operator error, change in scrubber/separator performance as inlet pressures decrease, gas compositions change which may increase liquid loading, etc.). As used herein, the term "atomize" means to divide, reduce, or otherwise convert a liquid into minute particles, a mist, or a fine spray of droplets having an average droplet size within a predetermined range. In some embodiments, a flow mixer in the suction line may provide an order of magnitude reduction in droplet size, effectively atomizing the liquid. Atomized liquid may represent a lower risk to rotating parts than large droplets or slugs of liquid, thereby substantially reducing the business risk of liquid carry-over events (e.g., damaged compression components). However, it is contemplated that these benefits may be outweighed and non-atomized liquid may be suitable in other contexts.

Figure 2:
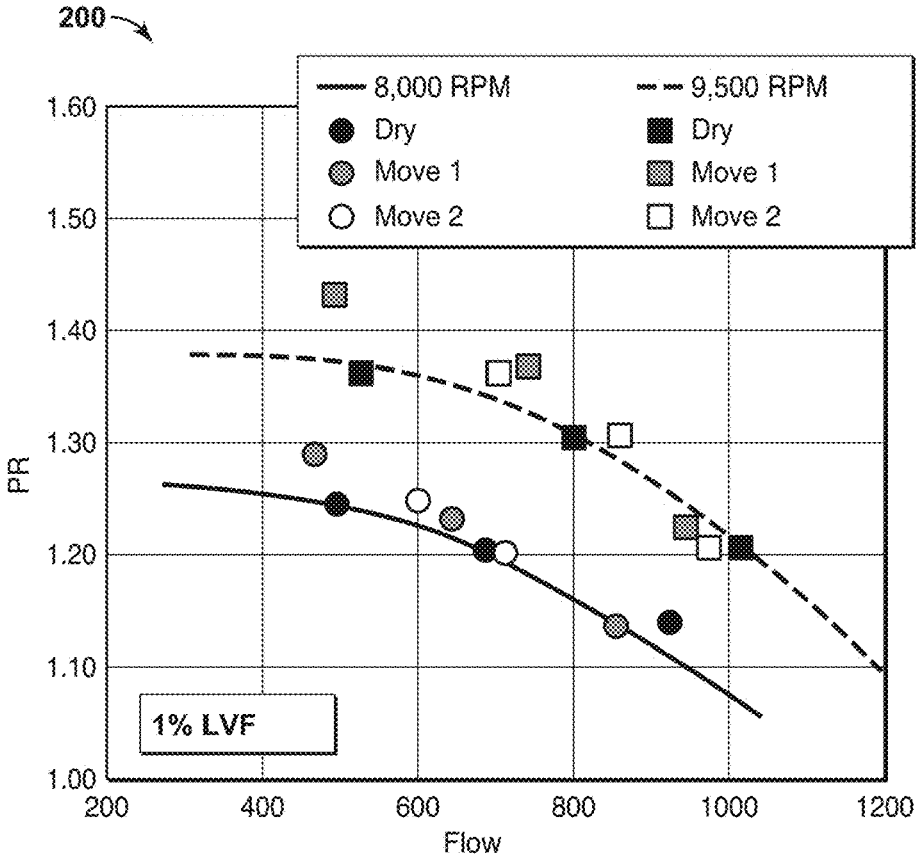
FIG. 2 is a compressor performance map plotting compressor operation for one percent (1%) Nominal Liquid Volume Fraction (LVF) at various flow and pressure ratio conditions.

FIG. 2 is a compressor performance map 200 plotting compressor operation for an injection of one percent (1%) Nominal Liquid Volume Fraction (LVF) for an embodiment of the disclosed technique. The Y-axis is the PR and the X-axis is the air flow in ACFM. Initially, a compressor was measured at three different operating conditions using a compressor speed of 8,000 revolutions per minute (RPM) and 9,000 RPM on dry gas. Move 1 shows the data associated with adding an injectant, e.g., water, to obtain a 1% LVF input stream. Move 2 shows the adjustment to flow made to obtain substantially the same PR for the compressor at the given speed and with a 1% LVF input stream. As depicted, increasing the LVF (Move 1) increased the PR for a given flow at a given compressor speed at lower flow rates and had a negligible or lessening effect at higher flow rates. In other words, injecting liquid translated the operating curve in a clockwise orientation about a known point. In Move 2, the air flow was increased while the liquid flow rate was held constant to reduce the PR back to substantially the same as the dry value. As depicted, Move 2 translated the curve to the right along the X-axis, compressed the curve, and further translated the curve clockwise about a known point.

Figure 3:
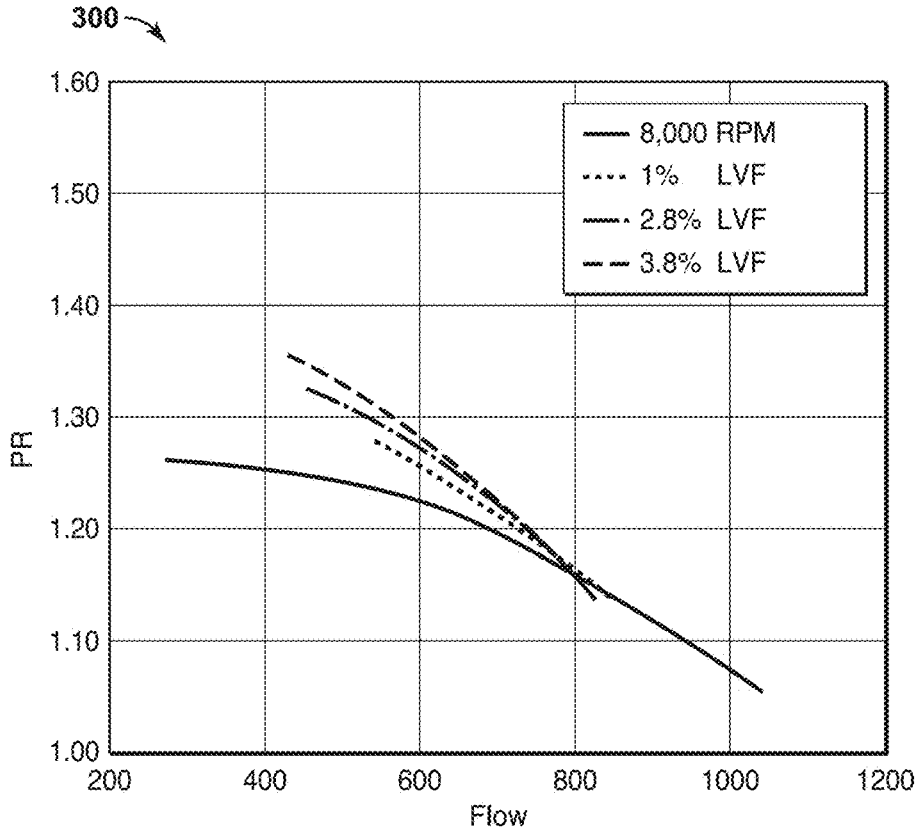
FIG. 3 is another compressor performance map plotting compressor operation for increasing LVFs at a given speed which show how the pressure ratio varies with the quantity of liquid.

FIG. 3 is a compressor performance map 300 plotting compressor operation for an injection of various LVFs, i.e., 1% LVF, 2.8% LVF, and 3.8% LVF, at a given speed (8,000 RPM). The Y-axis is the PR and the X-axis is the air flow in ACFM. As depicted, for a given compressor operating speed, e.g., 8,000 RPM, increasing the LVF tends to raise the PR at lower flows and has a negligible or lessening effect on the PR at higher flow rates. In other words, raising the LVF by injecting liquid translates the operating curves in a clockwise orientation about a known point.

Figure 4:
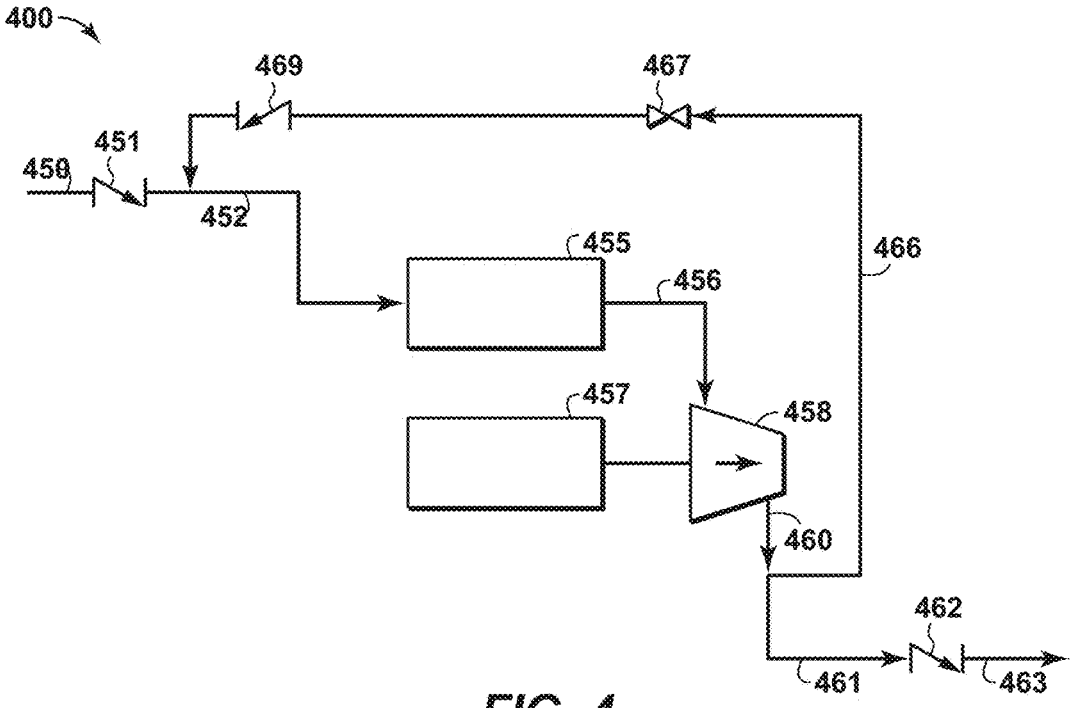
FIG. 4 is a schematic diagram of one embodiment of a multiphase fluid handling system according to the disclosure for compressing a multiphase fluid.

FIG. 4 is a schematic diagram of a compression system 400. Fluid, for example fluid from a well head or separator, is directed to the apparatus by a conduit 450, check valve 451, and conduit 452. The mixture of liquid and gas enters a fluid treatment device 455. The fluid treatment device 455 may be a slug suppressor or a known atomizing device, such as one or more atomizing nozzles or flow mixers, to include a static flow mixer, a dynamic flow mixer, or a combination thereof. The fluid treatment device 455 may also be a combination of these elements. Suitable atomizers may generate droplets havining an average droplet size on the order of about 1,000 μm to about 1,500 μm, about 1,000 μm to about 2,000 μm, about 2,000 μm to about 3,000 μm, or larger, while other suitable atomizers, e.g., gas-assisted atomizers, may generate droplets having an average droplet size at least an order of magnitude less than the large droplets (e.g., from about 50 μm to about 100 μm, about 100 μm to about 200 am, about 50 μm to about 200 μm etc.). The mixture leaving the fluid treatment device 455 flows through conduit 456 to compressor 458 driven by a driver 457, e.g., a motor, a turbine, a variable frequency drive (VFD etc. In some embodiments, a multi-phase flow meter (MPFM) device (not pictured) is disposed in the conduit 456 to accomplish liquid injection. In some embodiments, this MPFM is disposed close to the compressor suction nozzle to minimize the likelihood of atomized droplets coalescing in the inlet nozzle and/or compressor volute. Such embodiments may utilize the MPFM output to control the ratio of the various streams to obtain the required amount of liquid to obtain the desired operating characteristic, e.g., power, temperature, pressure, erosion characteristics, etc. Additionally, for embodiments having a plurality of inlet sources, the MPFM may be configured to receive a plurality of inlet sources or a plurality of MPFMs may be individually employed for each of the inlet sources. Compressed fluid leaves compressor 458 through conduit 460 and 461 to check valve 462 and to a distribution conduit 463 which delivers the compressed fluid to a desired location. A recycle line for the mixture from compressor 458 is provided at 466 that includes a recycle valve 467, and check valve 469. In some embodiments, the distribution conduit 463 may include additional branches, after coolers, moisture separators or other devices for separating/treating the liquid from the gas and passing a single phase stream downstream out of the compression system 400. Those of skill in the art will appreciate that the compressor 458 may be any suitable centrifugal compressor, e.g., a multi-stage centrifugal compressor, within the scope of this disclosure.

Figure 5:
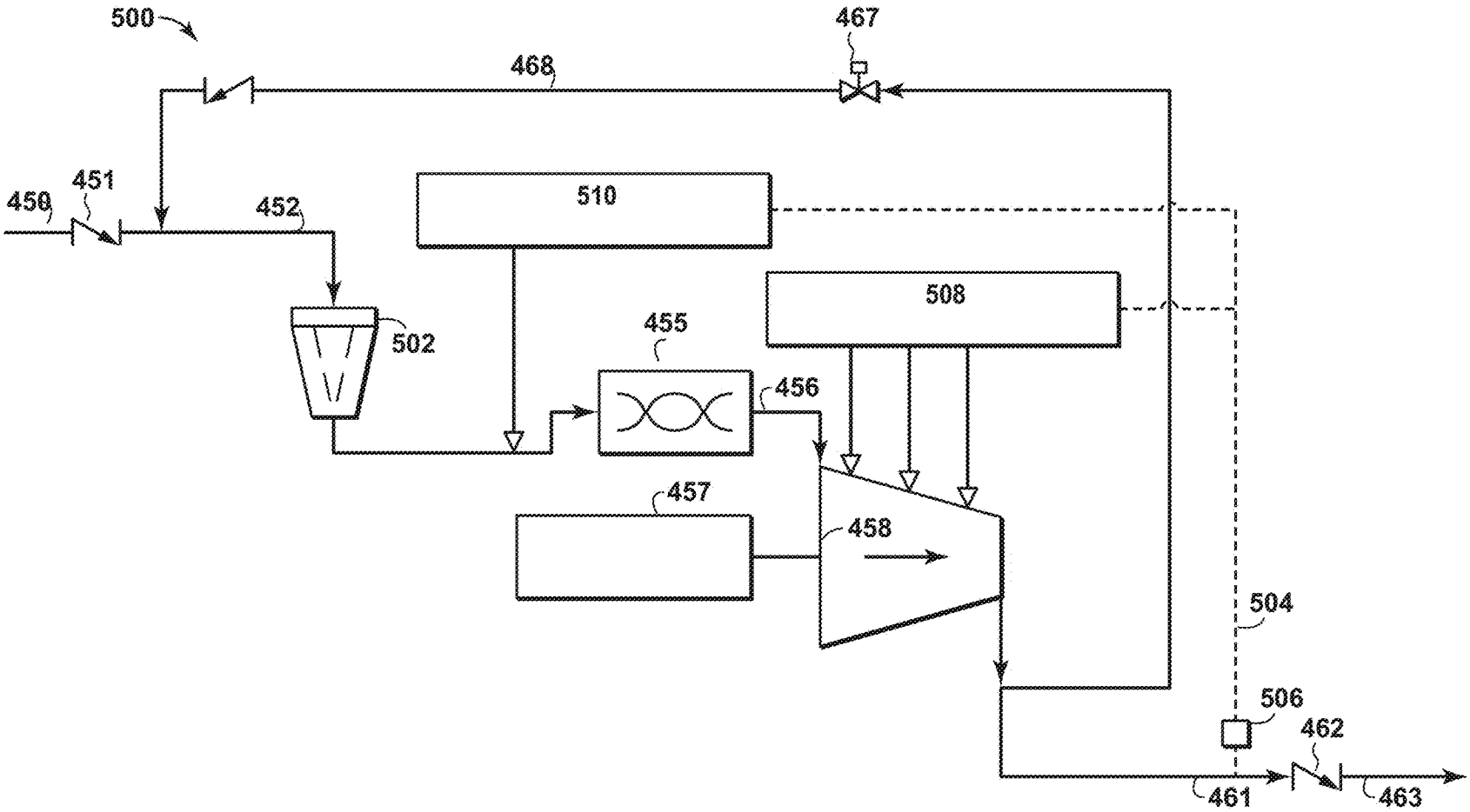
FIG. 5 is a schematic diagram of another embodiment of a multiphase fluid handling system according to the disclosure for compressing a multiphase fluid.

FIG. 5 is a schematic diagram of an exemplary compression system 500 in accordance with this disclosure. The components of FIG. 5 are substantially the same as the corresponding components of FIG. 4 except as otherwise noted. The compression system 500 includes an optional suction scrubber 502. In the compression system 500, the fluid treatment device 455 is a flow mixer and/or atomizer, an atomizer comprising one or more atomizing nozzles or a flow mixer device comprising two or more counter swirling vanes or counter rotating vortices. The compression system 500 depicts a feedback loop 504 having a controller 506. The controller 506 may monitor discharge pressure and control the injectant fed back to the compression system 500 via the feedback loop 504. The feedback loop 504 is depicted in dashed lines to illustrate the optional configurations alternately or cumulatively available in some combinations and permutations contemplated herein. For example, if injection location 508 is selected, injectant may be metered and/or injected internally to the compressor 458 at any one or more of the illustrated locations, e.g., the compressor inlet and/or a compressor interstage passage. Alternately or additionally, if injection location 510 is selected, injectant may be metered and/or injected upstream of the fluid treatment device 455. The injection location 508 and injection location 510 may have the same or different liquid supply, and in various embodiments may each have one or more different liquid supplies. The injection location 508 and the injection location 510 may utilize one or a plurality of liquid injection ports to pass liquid to the compression system 500. In some embodiments, one or more liquid injection ports may be disposed upstream of a fluid treatment device 455. In some embodiments, one or more liquid injection ports may be disposed on the compressor 458, e.g., at the compressor inlet and/or a compressor interstage passage. In embodiments having a plurality of liquid injection ports, each port may be separately controlled or controlled as part of a bank of liquid injection ports with respect to the quantity of liquid passed therethrough. Alternatively or additionally, in embodiments having a plurality of liquid injection ports, one or more liquid injection ports may be configured to pass a different liquid than another liquid injection port.

Figure 6:
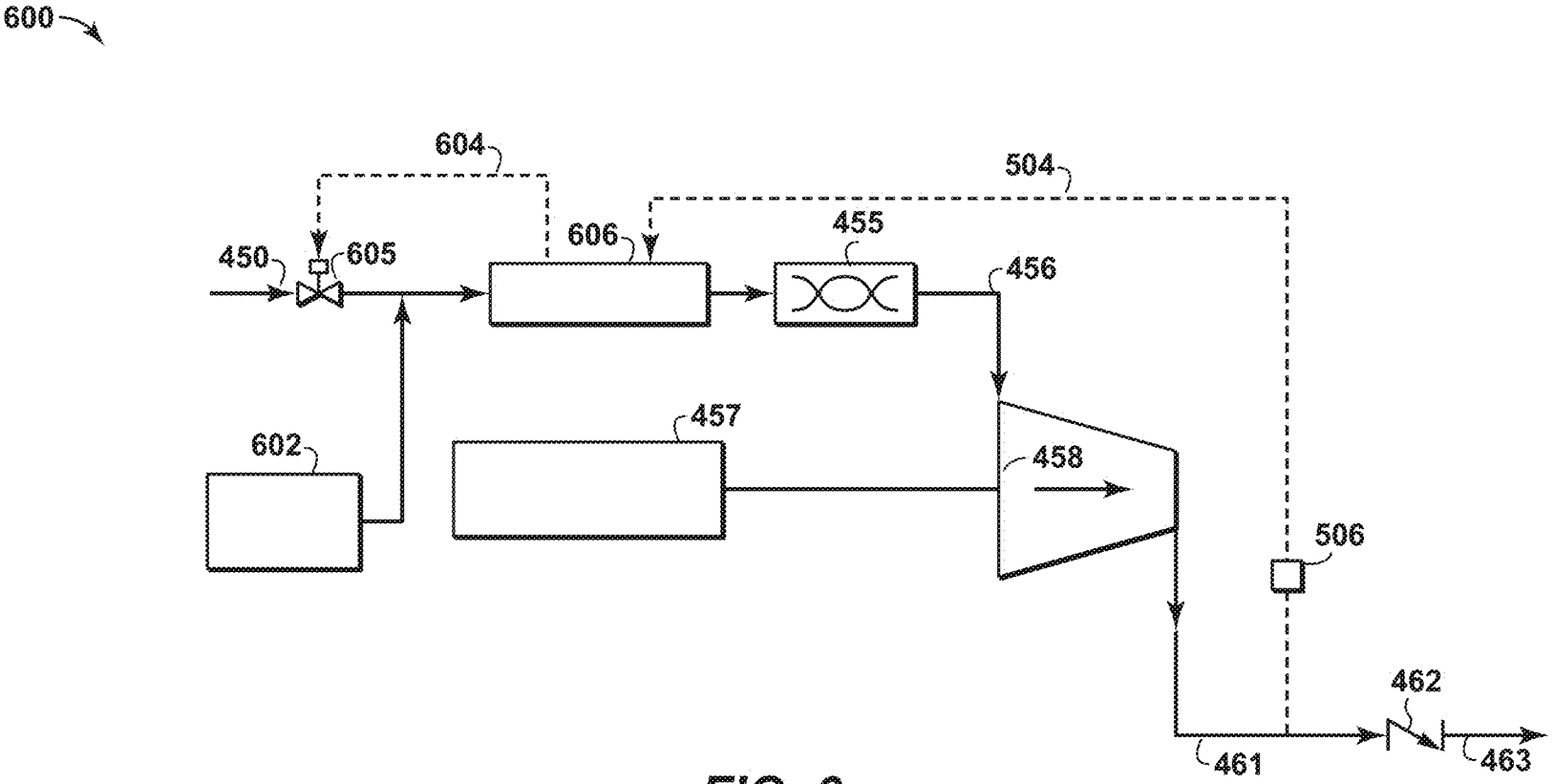
FIG. 6 is a schematic diagram of still another embodiment of a multiphase fluid handling system according to the disclosure for compressing a multiphase fluid.

FIG. 6 is a schematic diagram of another embodiment of a compression system 600 in accordance with this disclosure. The components of FIG. 6 are substantially the same as the corresponding components of FIG. 5 except as otherwise noted. The compression system 600 further comprises a process inlet 602 for admitting process fluid, e.g., a process gas, and a multiphase flow meter 606. Other embodiments may utilize multiple process inlets 602, e.g., to accommodate multiple process gases, but only one is shown in FIG. 6. Similarly, other embodiments may utilize multiple conduits 450 (and/or associated control and/or feedback loops) within the scope of this disclosure, e.g., to accommodate multiple kinds of liquids, but only one is shown in FIG. 6. The multiphase flow meter 606 may generate the set point to control the amount of wet gas entering the compressor 458 via the fluid treatment device 455. Those of skill in the art will appreciate that other embodiments may alternately or additionally control the amount of dry gas entering the compressor to similar effect. A feedback loop 604 is provided for aiding in the control of the amount of wet gas entering the compressor 458, e.g., using the control valve 605. A second feedback loop 504 is provided for substantially the same purpose as the feedback loop 504 of FIG. 5. The feedback loop 604 and the feedback loop 504 are depicted in dashed lines to illustrate other optional configurations alternately or cumulatively available in some combinations and permutations contemplated herein. As shown, the feedback loop 504 couples the conduit 461 to the multiphase flow meter 606 for wet gas recycling. Those of skill in the art will appreciate that alternate embodiments may include one or more additional feedback loops for speed control, discharge throttling, suction throttling, recycle control, inlet guide vane control, etc.

In operation, the PR for the compression systems 400, 500, and 600 may be controlled by introducing a liquid injectant into an input stream (e.g., passed via conduit 450) to create a multiphase input stream. The compression systems 400, 500, and 600 may compress the multiphase input stream with a centrifugal compressor e.g., the compressor 458) to create a multiphase discharge stream (e.g., passed via conduit 461). The compression systems 400, 500, and 600 may measure (e.g., using the multiphase flow meter 606) a parameter of the streams (e.g., suction pressure, discharge pressure, suction flow, discharge flow, and/or multiphase composition), wherein the discharge parameter corresponds to a PR for the centrifugal compressor. When the measured parameter exceeds a first predetermined point (e.g., when the measured PR drops below a minimum PR set point, when the compressor starts to surge, when the moisture composition of the measured stream passes an impeller erosion limit, etc.), a control system (e.g., the controller 506) may increase or decrease the pressure ratio by increasing or decreasing (e.g., by manipulating the recycle valve 467, the control valve 605, etc.) the quantity of liquid introduced into the compression systems 400, 500, and 600. Again, the liquid may be atomized for purposes of minimizing erosion, but for purposes of controlling the operating point it may be non-atomized.

While it will be apparent that the invention herein described is well calculated to achieve the benefits and advantages set forth above, it will be appreciated that the invention is susceptible to modification, variation and change without departing from the spirit thereof.

What is claimed is:

1. A method of controlling a pressure ratio for a compressing system, comprising:

introducing a quantity of liquid into an input stream to create a multiphase input stream;

compressing the multiphase input stream with a centrifugal compressor to create a discharge stream;

measuring a parameter of the discharge stream, wherein the discharge parameter corresponds to a pressure ratio for the centrifugal compressor; and altering the pressure ratio by changing the quantity of liquid introduced into the input stream based on the parameter, wherein when the parameter exceeds a first predetermined point, increasing the pressure ratio of the centrifugal compressor by increasing the quantity of liquid introduced, and when the parameter exceeds a second predetermined point, decreasing the pressure ratio by decreasing the quantity of liquid introduced.

2. The method of claim 1, wherein the liquid is introduced at an input of the centrifugal compressor.

3. The method of claim 1, further comprising passing a single phase stream out of the compressing system.

4. The method of claim 1, wherein measuring the parameter comprises measuring at least one of suction pressure, discharge pressure, suction flow, and discharge flow.

5. The method of claim 1, wherein the liquid is atomized before being introduced into the compressor.

6. The method of claim 1, wherein the liquid comprises at least one of produced water, a liquid hydrocarbon, a corrosion inhibitor, a process liquid, a diluent, a liquid chemical, a drilling fluid, and a fracking fluid.

7. The method of claim 1, wherein the parameter is a quantity of liquid in the discharge stream.

8. The method of claim 1, further comprising selecting the liquid based at least in part on the density of the liquid.

9. The method of claim 1, wherein the liquid is introduced at one or more interstage passages of the centrifugal compressor.

10. The method of claim 9, wherein the liquid is also introduced at an inlet of the centrifugal compressor.

* * * * *